US007104336B2

(12) United States Patent
Ozment

(10) Patent No.: US 7,104,336 B2
(45) Date of Patent: Sep. 12, 2006

(54) METHOD FOR FIGHTING FIRE IN CONFINED AREAS USING NITROGEN EXPANDED FOAM

(76) Inventor: Alden Ozment, 116 Hunter Creek Dr., Longview, TX (US) 75605

( * ) Notice: Subject to any disclaimer, the term of this patent is extended or adjusted under 35 U.S.C. 154(b) by 184 days.

(21) Appl. No.: 10/942,065

(22) Filed: Sep. 15, 2004

(65) Prior Publication Data

US 2005/0224239 A1 Oct. 13, 2005

Related U.S. Application Data

(63) Continuation-in-part of application No. 10/620,882, filed on Jul. 16, 2003.

(60) Provisional application No. 60/398,501, filed on Jul. 25, 2002.

(51) Int. Cl.
*A62C 2/00* (2006.01)

(52) U.S. Cl. ..... 169/44; 169/15; 169/47; 169/64; 169/70; 239/310; 239/318; 239/422; 239/427; 239/428; 239/8

(58) Field of Classification Search ..... 169/14, 169/15, 44, 46, 47, 64, 66, 68, 70; 239/8, 239/310, 317, 318, 419.3, 422, 424, 427, 239/427.3, 428, 427.5; 252/2, 3, 8.05
See application file for complete search history.

(56) References Cited

U.S. PATENT DOCUMENTS 3,172,477 A * 3/1965 Grisdale et al. ..... 169/15
3,272,263 A * 9/1966 Jamison ..... 169/15

(Continued)

OTHER PUBLICATIONS

Hookham, Marian, New multi-class foam suppresses fire, International Longwall News web site, Mar. 1, 2004, pp. 1-2, downloaded at http://www.longwalls.com/storyview.asp?storyid=22742&sectionsource=s0 on Mar. 3, 2004.

*Primary Examiner*—Steven J. Ganey
(74) *Attorney, Agent, or Firm*—Stites & Harbison PLLC; John E. Vanderburgh

(57) ABSTRACT

The method of the invention comprises the steps of proportioning a foam concentrate into a non-flammable liquid to form a foam concentrate/liquid mixture and creating a flowing stream of the foam concentrate/liquid mixture. Nitrogen is introduced into the stream of the foam/liquid mixture to initiate the formation of a nitrogen expanded foam fire suppressant. In one embodiment the nitrogen is chilled below ambient temperature. The flowing stream carrying the initially nitrogen expanded foam is dispensed, which completes the full expansion of the nitrogen expanded foam fire suppressant, into the confined area involved in fire thereby to smother the fire and to substantially close off contact between combustible material involved in fire and the ambient atmosphere substantially reducing the danger of explosion or flash fires. The system for creating and dispensing the nitrogen expanded foam can be self-contained and includes a proportioner, a source of foam concentrate, a source of nitrogen and a dispenser for completing the extension and dispensing of the nitrogen expanded foam. A chiller can be included to chill the nitrogen below ambient temperature. Optionally a power generator can be incorporated into the system in instances where power is not available. The apparatus for expanding and dispensing foam comprises a housing defining an interior through which extends a discharge line. The ends of the housing are closed about the ends of the discharge line and the ends of the discharge line extend beyond the ends of the housing to define a connector at one end for receiving a stream of foam concentrate/liquid and at the opposite end to define the foam dispensing end of the apparatus. A portion of the discharge line in the housing defines an eductor for introduction of the expanding gas into the stream of foam concentrate/liquid flowing through the discharge line.

17 Claims, 4 Drawing Sheets

U.S. PATENT DOCUMENTS 4,641,711 A * 2/1987 Terry ..... 169/44
5,623,995 A * 4/1997 Smagac ..... 169/15
5,632,338 A * 5/1997 Hunter ..... 169/15
5,799,735 A * 9/1998 Sundholm ..... 169/15

* cited by examiner

METHOD FOR FIGHTING FIRE IN CONFINED AREAS USING NITROGEN EXPANDED FOAM

CROSS REFERENCE TO RELATED APPLICATIONS

This application is a continuation-in-part application of application Ser. No. 10/620,882, filed Jul. 16, 2003, entitled METHOD AND APPARATUS FOR FIGHTING FIRES IN CONFINED AREAS which in turn claims the priority of the filing date of provisional application Ser. No. 60/398,501, filed Jul. 25, 2002 and entitled METHOD AND APPARATUS FOR FIGHTING FIRES IN CONFINED AREAS, both of which are incorporated by reference herein.

BACKGROUND OF THE INVENTION

Fires in sites that are partially or totally confined are extremely difficult to contain much less to extinguish due to a number of factors among which are included, but not limited to, factors such as heat buildup, the ready availability of fuel and the presence of toxic gases, all of which make delivery of fire suppressant material and extinguishing of the fire very difficult. Confined areas include locations such as structures, storage tanks, subway and highway tunnels and underground mines as well as other types of below surface fires, such as landfill fires for example. These sites can combine the worst dangers to property and life in that the hot combustion gases are confined and can be prone to explosion and can provide additional fuel to the fire. In addition the combustion gases normally contain toxic levels of carbon monoxide gas, methane gas and other toxic substances. In coal mine fires, for example, the abundance of fuel in a confined, poorly accessible area practically guarantees that the fire will burn for extremely long periods of time with resultant loss of production and substantial property loss. Many coal mines must be abandoned in the event of a fire because of the great difficulty in extinguishing the fire. For example the Jonesville coal mine fire started more than 30 years ago and is still burning. The town of Centrala, Pa. has been abandoned because of a coal mine fire that began in 1961 because of the seeping of noxious gases to the surface. The residents of the City of Youngstown, Pa. have seen their priority values drop to near zero and they are concerned that they will lose their homes due to the Percy mine fire in Fayette County, Pennsylvania that has been burning for more than 30 years.

Although not necessarily prone to the extremely long burning periods encountered in coal mine fires, other fire locations such as underground fuel storage tanks, above ground chemical storage tanks and the like present similar problems in extinguishing fires occurring therein. It is difficult to apply fire suppressant material to the fire because of the location of the fire in a confined area and the resultant danger to the fire firefighters from explosion, heat buildup and toxic gases.

The usual fire suppressant material utilized in the fires even for fire in confined areas is water. However, water is quickly vaporized at the high temperatures encountered in confined areas engulfed in fire and relatively ineffective in extinguishing such fires. Furthermore, areas of active burning and/or high surface temperatures that can result in ignition can occur on the sides or upper surfaces of a confined area. These areas must be contacted with fire extinguishing material in order to smother the fire and to reduce the surface temperature. Liquid fire extinguishing materials are effective only for the lower surface of a confined area, unless the area is completely filled with the liquid. In most situations, this is impractical, if not impossible, and highly expensive. Air expanded foam has been suggested as a fire suppression material for a confined areas. However, air expanded foam actually supplies additional fuel, oxygen, to the fire which, as it is consumed, results in a breakdown of the foam so that the foam does not have the smothering properties necessary for effective fire extinguishing. Accordingly, foam has not generally been accepted as a suitable fire extinguishing material for fires in confined areas. The latest concept uses a jet engine thrust of water vapors and inert gases into a mine to smother the fire. This requires months of preparation, including the development of a mounting structure to support the jet when subjected to the engine load on thrust dynamics. Moreover, a new mounting structure would have to be designed for each mine that would appear to be cost prohibitive.

Therefore, a need exists to address the aforementioned deficiencies and inadequacies.

SUMMARY OF THE INVENTION

The present invention relates to a method and apparatus for extinguishing a fire in a confined, normally poorly ventilated area. In one embodiment the invention comprises a method for extinguishing a fire in a confined area comprising the steps of: (i) providing at least one foam ingress point to said portion of the confined area involved in fire; (ii) proportioning a foam concentrate into a non-flammable liquid to form a foam concentrate/liquid mixture; (iii) forming a foam fire suppressant by introducing gas consisting essentially of nitrogen under pressure to said foam concentrate/liquid mixture to expand said foam concentrate in said non-flammable liquid; and (iv) introducing said expanded foam fire suppressant through said foam ingress point. Where possible, it is preferred to form a seal between a portion of the confined area involved in fire and uninvolved portions of the confined area and dispensing the nitrogen expanded foam while maintaining the seal between said portions of the confined area involved in fire and said uninvolved potion of the confined area. The nitrogen expanded foam fire suppressant acts to smother the fire and to substantially prevent contact between combustible material in the confined area involved in first and the ambient atmosphere thus substantially reducing the danger of explosion or flash fires.

In another aspect, the present invention provides a system and method for extinguishing a fire in a confined area utilizing chilled nitrogen expanded foam. In this regard, one aspect of the method comprises forming a stream of surfactant treated non-inflammable liquid and introducing nitrogen chilled to a temperature of less than normal room temperature to initiate the formation of an improved fire extinguishing foam that is expanded by the chilled nitrogen.

The present invention can also be viewed as providing a method for fighting a fire in confined area utilizing nitrogen expanded foam which is dispensed at a temperature below ambient temperature.

In another aspect of the invention, there is described apparatus for producing and dispensing ambient temperature or chilled nitrogen expanded foam. In this regard one embodiment of the system, among others, includes a source of non-inflammable liquid, a source of surfactant, a proportioner for introducing the foam concentrate into the non-flammable liquid, a nitrogen generator, and a dispenser for expanding and dispensing the nitrogen expanded foam.

Optionally, a pressure booster unit and chiller for the nitrogen and an auxiliary pump for the non-flammable liquid may be incorporated into the system as required.

In still another aspect of the invention the dispenser apparatus of the present invention comprises a housing defining an interior having end walls, a discharge line extending through said housing, said discharge line having a first open end and a second open end, said end walls being closed about said discharge line, said first and second ends of said discharge line extending beyond said end walls of said housing to define a connector at said first end for receiving a stream of foam concentrate/liquid and said second end defining a foam dispensing end of said apparatus, a portion of said discharge line in said housing being provided with at least one opening to define an eductor for introduction of an expanding gas into said stream of said foam concentrate/liquid flowing through the discharge line.

The method and apparatus of the instant invention eliminates the problems associated with conventional air expanded fire suppressant foam that provides fire-stimulating oxygen which essentially defeats the purpose and function of the fire-fighting foam. The present invention allows for the dispensing of the nitrogen expanded foam to be accomplished without the necessity of personnel being exposed to toxic combustion by-products. In addition, however, the apparatus of the invention is transportable by conventional means, including by air, and can be set up and ready to use in a matter of hours.

Other systems, methods, features, and advantages of the present invention will be or become apparent to one with skill in the art upon examination of the following drawing and detailed description. It is intended that all such additional systems, methods, features, and advantages be included within this description, be within the scope of the present invention, and be protected by the accompanying claims.

DESCRIPTION OF THE INVENTION

As used herein the term "confined area" means a site having normally linked ventilation and limited access for extinguishing a fire. The term includes total and partial confinement of the area involved in fire. In a totally confined area the portion of the combustible material comprising the confined area is essentially sealed and isolated from the surface. In a partially confined area a portion of the combustible material comprising the confined area is exposed to the surface. In partial and totally confined areas combustion by-products can accumulate and may pose a threat to personnel attempting to extinguish such a fire. In addition, if the site is an operational site such as a working coal mine or a land fill, the presence of such a fire can result in the cessation or limitation of operations until the fire is extinguished or at least controlled which can result in severe economic and social hardship.

Fires in confined areas are difficult to extinguish because of the buildup of explosive or combustible gases that feed the fire and make extinguishing of such a fire dangerous and difficult if not impossible. The confined area provides a containment area for dangerous combustion by-products. Fires occurring in partially confined areas such as landfill and dump fires or fires occurring at areas where quantities of combustible materials are stored, such as storage tanks for flammable materials, tire and paper storage sites are likewise difficult to extinguish. Although a portion of the combustible material is exposed to the surface and can be readily contacted with a fire extinguishing material, fire can continue to burn in confined areas in the interior of the combustible material away from the surface. This raises the temperature of the combustible material and the burn can erupt to the surface and re-ignite the surface fire.

Figure 1:
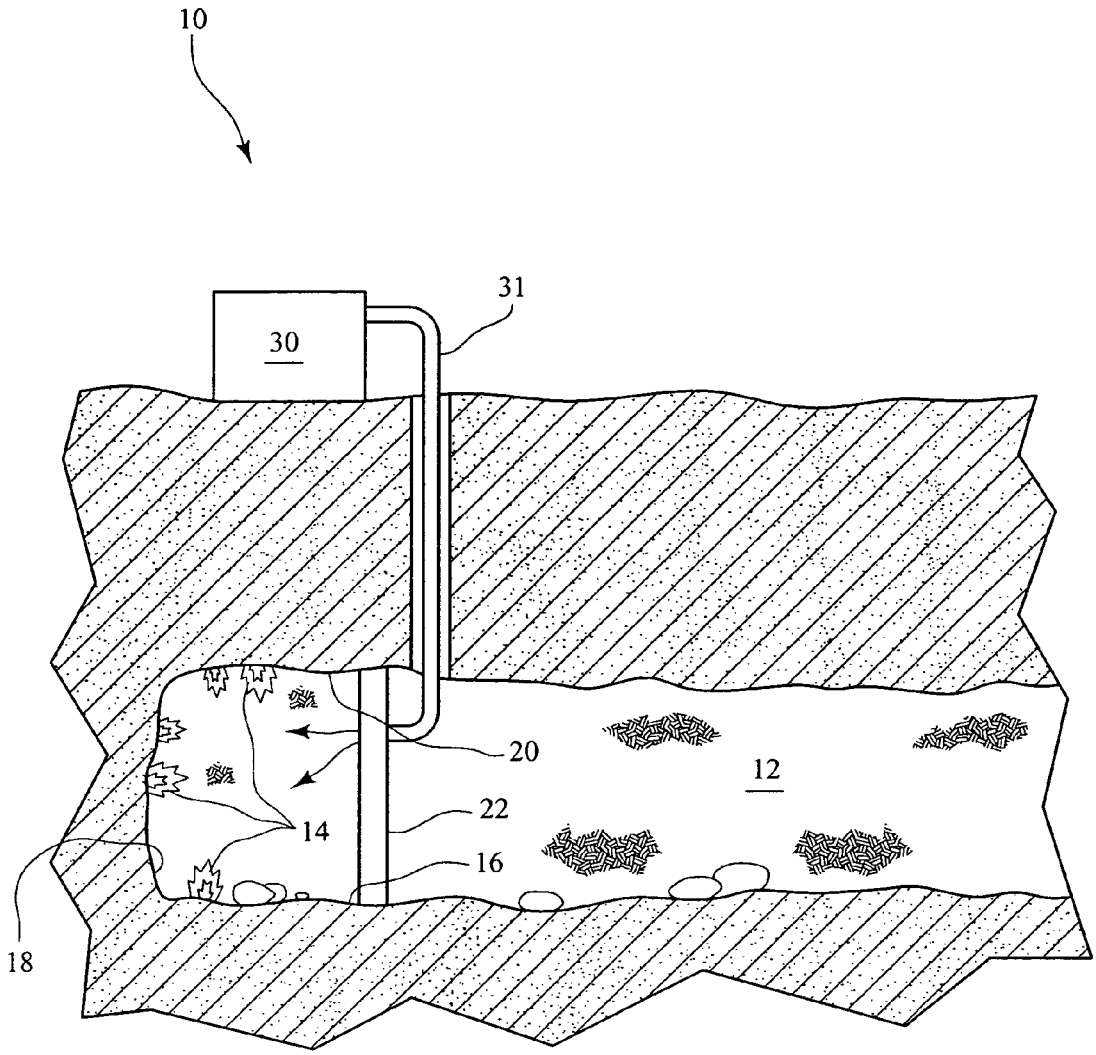
FIG. 1 is a sketch showing a typical closed coal mine in which a fire is actively burning.

The present invention is directed to a system and method for extinguishing a fire in a confined area involved in combustion by contacting the involved area with a nitrogen expanded foam having improved smothering and fire extinguishing properties as compared to liquid products, particularly water, or conventional air expanded foam. The nitrogen expanded foam exhibits the necessary flow properties and can be dispensed at pressures necessary for reaching and penetrating the fuel source in the confined area. In addition, the nitrogen expanded foam has the necessary structural integrity to fill a confined area and contact not only a bottom wall or floor of the confined areas but also the top and side walls as well to extinguish burning areas occurring on such surfaces. Liquid products cannot extinguish fires occurring on the top and side walls. This is illustrated by FIG. 1 that shows a section of an underground coal mine, indicated generally as 10, that includes a working shaft or chamber 12 where a filter, illustrated as burning areas 14, has broken out on the bottom wall 16, end wall 18 and top wall of a portion of the working chamber. Upon discover of the fire personnel are immediately evacuated and mining operations terminated.

The method for fighting a fire in a confined areas such as in the working chamber 12 conventionally comprises the steps of (i) constructing a seal 22 for sealing the portion of the not already been sealed such as when the chamber is abandoned or closed; (ii) drawing out as much air as possible from the involved areas; (iii) introducing a fire suppressant such as water, while maintaining the involved area sealed.

Various types of seals and seal construction are known in the art and do not per se form a part of this invention. For example, permanent and temporary seals or brattices are well known and have been long used in the mining field for sealing portions of a passage or shaft in a mine. Brattices of varying designs are used to for ventilation control and for emergencies, such as in the event of a fire. For the purposes of the present invention the sealing element must be fire proof and provide a suitable opening to permit the dispensing of foam to the area involved in the fire. A discussion of several different brattice designs is found in U.S. Pat. No. 5,683,294, granted Nov. 4, 1997 to Teddy Maines.

Practicing the conventional fire-fighting techniques normally require the involved area to be out of production for many weeks or months before it is safe to allow working personnel back into the affected area of the mine. In some instances the entire mine is closed for extended period of time and in some cases even permanently if the fire cannot be extinguished.

In mine fires where the involved area is sealed, it is preferred that the atmosphere in the sealed area is drawn out so as to reduce as much as possible the oxygen in the sealed area to limit or slow the progress of the fire. This may followed by an attempt to flood the area with water.

Water is not the most effective fire suppressant or extinguishing material for use in most confined area fires, particularly in fighting coal mine fires. In many cases the water does not reach the fire because of dips and fissures in the mine shaft that in effect pool, retain or otherwise divert the water and prevent it from reaching the fire. In addition, the contact time of water that does reach the fire is short and the water evaporates and does not thoroughly penetrate and/or wet the fuel supporting the fire. Moreover, attempts to flood the involved area are impractical unless the burning area 14 is confined to the bottom wall 16 because of the many imperfections in the walls of the working chamber 12 that allow the liquid to run out of the confined area making it impossible to reach the burning areas 14 that occur at the upper wall 20 and higher portions of the end wall 18.

Conventional air expanded foam has been applied in attempting to extinguish coal mine fires. This foam is expanded with air that, of course, contains a substantial concentration of oxygen thus adding a highly combustible substance to the fire that becomes available to support combustion as the foam breaks down. In the bond, Mine Fires by Donald W. Mitchell, Interec Publishing, Inc., 29 North Wacker Drive, Chicago, Ill. 60606, in a chapter entitled High-Expansion faom, the author discusses the use of foam in mine fires and introduces the chapter relating to the use of foam (p 175) with the statement, "[H]igh expansion foams have not yet extinguished a real mine fire."

In accordance with the invention nitrogen expanded foam is used in step (iii) as the primary fire suppressant material rather than a liquid or inert gas fire suppressant. As will be seen from Example 1, an actual mine fire was extinguished in a matter of days rather than weeks or months as would be the normal situation where a liquid fire extinguishing material, such as water, is used in an attempt to extinguish the fire.

Figure 2:
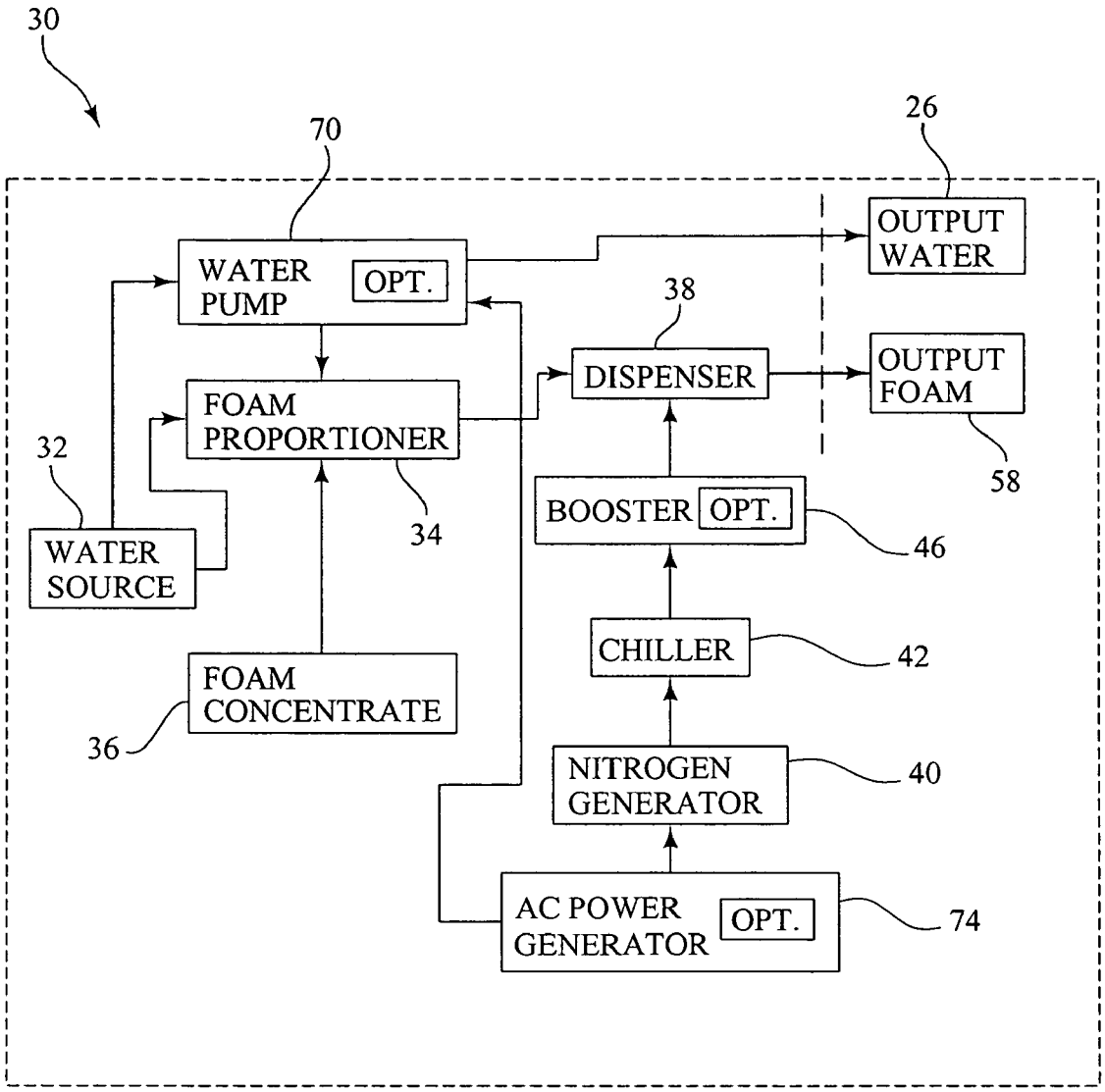
FIG. 2 is a schematic flow diagram illustrating a typical system utilizing the method of the present invention.

As shown in FIG. 1 and FIG. 2, a system 30 for generating nitrogen expanded foam in accordance with the present invention is positioned on the surface and a line 31 is inserted from the apparatus into the working chamber 12, preferably adjacent to the seal 22. Access to the working chamber 12 can be provided by an existing vent shaft, cable shaft or the like or if such access is not available, a bore can be drilled. The nitrogen expanded foam can be dispensed through the seal 22 into the involved area. Generation of the nitrogen expanded foam and dispensing of the foam is continued until temperature measurements in the sealed area that was involved in the fire are brought down to about 90° F. This is the temperature that is accepted as the point at which the fire is considered to be extinguished. The nitrogen expanded foam has the density and structural integrity that permit it to essentially completely fill the sealed portion of the chamber 12 and in this manner to also contact the burning area 14 in the upper portions of the end wall 18 and the top wall 20 to extinguish the fires burning on those surfaces as well as on the floor of the chamber.

Although, as will be seen from Example 1, good results have been obtained using nitrogen at ambient temperature to expand the foam, it is preferred that the nitrogen used to expand the foam be chilled prior to its introduction into a liquid/foam concentrate mixture prior to dispensing and expanding the foam. As will be seen from Example 2, the time required to bring the temperature of a burning area down to 90° F. is substantially shortened when the nitrogen used to expand the foam is at a reduced temperature.

Referring to FIG. 2, the system 30 for creating and dispensing nitrogen expanded foam is illustrated. The system 30 includes a source 32 of water that communicates with a proportioner 34 into which is fed a foam concentrate from a source 36. The initiation of foam begins in the proportioner 34 and the water/foam concentrate mixture is led into a dispenser 38 (FIG. 3) where it is mixed with nitrogen produced by a nitrogen generator 40. Nitrogen generators are well known in the art and the type of nitrogen generator used is a matter of choice. One type of nitrogen generator used with good results is a nitrogen membrane filtration unit.

For producing the chilled nitrogen expanded from a chiller 42 can be disposed in a line leading from the nitrogen generator 40 to the dispenser 38. The chiller 42 in its simplest form may consist of a heat conducting coil around the line leading from the nitrogen generator 40 to the dispenser 38 through which cold water is circulated to extract heat energy from the nitrogen and reduce its temperature below ambient. Accordingly the chiller 42 may be of any conventional design and does not per se form a part of this invention. It will be understood that the chiller 42 may be an integral part of the system 30 comprising the nitrogen generator 40 and that a separate chiller unit will not be required. The reduction of the nitrogen temperature is largely dependent on the size of the chiller 42. It is preferred, however, to reduce the nitrogen temperature to at least about 55° F. to effectively reduce by half the time to bring the surface temperature of the involved areas to 90° F., the temperature at which it is considered that the fire has been extinguished.

The foam is expanded and dispensed through a dispenser 38 that functions to introduce pressurized nitrogen into the water/foam concentrate stream to expand the foam and to dispense the expanded foam. Depending on the nitrogen generator 40, the foam is normally dispensed at between about 100 psi to about 250 psi. However, depending upon the condition of the confined area being treated, higher pressure may be required to insure that the foam reaches all of the area involved in fire. In such a case a power booster 46, such as for example a compressor of conventional design may optionally be employed to boost the nitrogen pressure above 250 psi.

Figure 3:
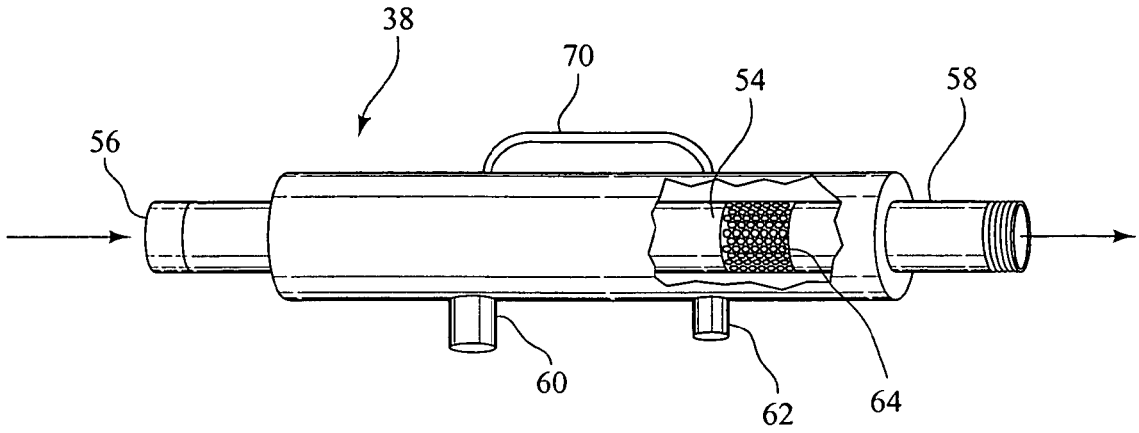
FIG. 3 is a side elevation of the apparatus for expanding and discharging foam in the method of the invention having a portion of its outer housing cut away to show the aspirator portion.
Figure 4:
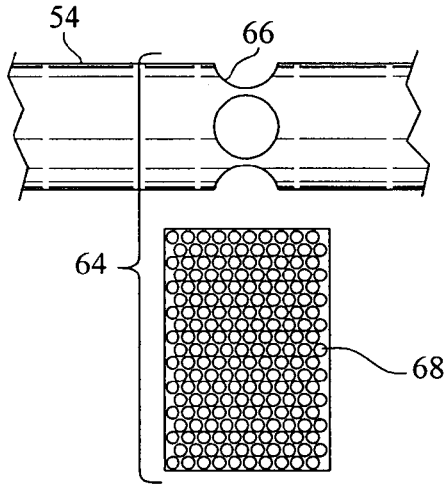
FIG. 4 is an exploded view of the aspirator of the apparatus of FIG. 3 in enlarged scale.

In accordance with one aspect of the invention, as shown in FIG. 3, the dispenser 38 comprises an outer cylindrical casing 52 through the interior of which extends a discharge line 54 parallel with the axis of the outer casing. The ends of the outer casing 52 are closed around the discharge line 54. One end of the discharge line 54 extends beyond the outer casing 52 to define an intake 56 that communicates with a source of the water/foam concentrate mixture. The opposite end of the discharge line 54 extends beyond the outer casing to define a discharge 58 for dispensing the highly expanded foam. A nitrogen intake nipple 60 communicates through the outer casing 52 for leading pressurized nitrogen from the nitrogen generator 40 into the outer casing and a drain nipple 62 communicates with the interior of the outer casing for draining excess fluid from its interior. A portion of the discharge line 54 defines an eductor 64 for entraining the nitrogen gas in the water/foam concentrate stream flowing through the discharge line. As more clearly shown in FIG. 4, the eductor 64 is formed by four openings 66 in the wall of the discharge line. Each of the openings 66 is spaced 90 degrees apart from adjacent openings. A metal screen 68 is disposed about the discharge line 54 to overlie the openings 66. For ease of handling the diffuser 38, a handle 70 is provided.

In operation, water and foam concentrate is mixed as the water flows through the proportion 34. The proportioner 34 is of a conventional design and does not per se form a part of the present invention. The water/foam concentrate stream flows into the intake 56 of the dispenser 38 while nitrogen under pressure is led into the interior of the outer casing 52 through the nipple 60 that communicates with a source of pressurized gas consisting essentially of nitrogen. It has been found that for best results that the nitrogen pressure should be greater than the water pressure. The nitrogen pressurizes the interior of the outer casing 52 and the flow of the liquid stream past the eductor 64 lowers the pressure in the interior of the outer casing adjacent the eductor to create a pressure differential that the nitrogen to be drawn into the flowing stream. The introduction of the nitrogen initiates the expansion of the foam and the foam is fully expanded as it leaves the discharge 58 of the dispenser 38. Both the flow of the liquid stream and the nitrogen pressure combine to propel the foam from the dispenser 38. Liquid that escapes out of the discharge line 54 through the openings 66 is drained from the interior of the outer casing 52 through the drain nipple 62.

Although it is not shown, a diffuser nozzle can be affixed to the end of the discharge 58 by suitable means such as by the provision of external threads on the end of the discharge that threadibly engage corresponding internal threads in the diffuser nozzle. The diffuser nozzle can be of any conventional design and although the use of such a nozzle is not required it does serve to enhance the expansion of the foam blanket.

Commercially available high expansion foam concentrates are used in producing the fire suppressant foam. The foam concentrate is a surfactant that is utilized to treat a nonflammable liquid, conventionally water, to produce foam when the foam concentrate treated liquid is aspirated with air or nitrogen. Class A and Class B foam concentrates are preferred for their ability to isolate the fuel. Class A concentrates may be easier to use because the proportioning of the concentrated and water is not as critical as for Class B foam concentrates. The foam concentrate may further include a wetting agent to aid in penetration of the fuel.

The proportion of foam concentrate in water depends on the desired density and viscosity of the expanded foam as dictated by the location and type of fire being extinguished in the proportions of the mixture can vary as a matter of choice by those skilled in the art. The foam concentrate, however, is normally proportioned with water in percentages ranging from about 0.1% by volume foam concentrate to about 1% by volume foam concentrate.

The choice of proportioning method is not critical. In some cases it may be desirable to premix the foam concentrate and water in a suitable container. Such proportioning method may be preferred in small fires where foam volume will be relatively small. This method also lends itself for use in portable equipment. Venturi type or line proportioning devices are suitable for both portable systems and for more stationary system where a high volume of foam is to be produced. Venturi type proportions are best suited in those situations where water pressure is essentially constant in order to insure proper proportioning of water and concentrate and delivery of foam at a constant rate. In cases where water pressure is not reliable a water pump 70 may be optionally incorporated in the system 30 to both raise water pressure and to ensure that it remains constant.

Other types of proportioners such as "around the pump" proportioners are well suited for delivery of large quantities of foam at a constant rate and as such are highly suited for disbursement of high expansion foam in fighting mine fires.

The system may be self-contained and adopted for mounting on structural frames to allow handling by forklifts, overhead hoists and the like for moving from place to place. An AC power generator 74 can be included to provide power for operation of the water pump 22 and other components such as the nitrogen generator 40 and, if present, the chiller 42 that may require electric power for operation. The self-contained system is compact and lends itself to movement by trailer, ship or even aircraft. As illustrated in FIG. 2, suitable valving (not shown) can be utilized to diver the flow of water directly into an outlet 26 such as for use of the apparatus in a water flooding operation prior to introduction of the chilled nitrogen foam.

EXAMPLE 1

The following is an example of the use of the method and apparatus of the present invention to extinguish a fire in an existing underground coal mine.

A roof fall behind two seals identified as Seals 6 and 8 on Level 1 of an underground coal mine was the probable cause of a fire started by spontaneous combustion. The fall provided the fuel and crated the atmosphere that was conducive to spontaneous combustion.

A rise in carbon monoxide concentrations at Seal No. 6 was found during a routine inspection. Once it was determined that the elevated carbon monoxide was not due to normal activities, all personnel, with the exception of those individuals allowed to repair seals and to collect samples were evacuated from the mine. For purposes of this example the sequence of events begins at day one with the evacuation.

By day four the site of the fire was located behind Seal No. 6. Installation of water injection pipes to Seal No. 6, as well as to Seal No. 8, began on day four. Additional seals were constructed adjacent to Seal Nos. 6 and 8 to form an airlock between the existing seals and the new seals. On day eight of the fire, dry chemical fire extinguishers were discharged behind the original Seal No. 6 and Seal No. 8. By day nine, the installation of the water pipes was completed and the area behind Seals 6 and 8 was flooded. Although further sampling indicated that the level of carbon monoxide and hydrogen concentration had reduced somewhat, the concentration of these gases remained at a dangerous level indicating that the fire was not extinguished. It was evident that water flooding had not successfully extinguished the fire.

On day fourteen of the fire, nitrogen expanded foam injection was started. The existing water pipes through Seals 6 and 8 were employed to provide access for the nitrogen foam into the area behind the seals.

The foam concentrate used was a class A foam concentrate for high expansion generators. The foam, which was not chilled, was generated and dispensed using the system without a chiller as described above in connection with FIGS. 1 and 2. The system included the diffuser described in connection with FIGS. 3–4.

The nitrogen used to expand the foam was generated on the surface at ambient temperature using a commercially available nitrogen membrane filtration unit. Two screw-type compressors supplied air to the nitrogen membrane filtration unit. The generated gas consisting essentially of nitrogen was delivered to the diffuser in the mine through an existing six-inch steel water discharge pipe.

The nitrogen generator was run for forty-five minutes after which nitrogen was pumped through the lines to the diffuser nitrogen hose to purge the lines of oxygen. Once purged, the diffuser nitrogen hose was connected to the nitrogen intake nipple of the diffuser. A water line attached to the intake of the diffuser was in communication with the pump for providing the water at the desired pressure and flow rate. The foam concentrate was introduced into the waterline upstream of the diffuser to form a water/foam concentrate mixture. Nitrogen pressure to the diffuser was maintained at a level of about 100 psi while the water pressure was maintained at about 90 psi. At all times, the nitrogen pressure was maintained at a level above that of the water. Prior to injection of the foam, sample foam was generated and the flow rate of the water/foam concentrate mixture was adjusted until foam having the consistency of shaving cream was produced.

Pressure was equalized behind Seals 6 and 8 and foam injection was initiated. Foam injection was monitored through existing monitoring pipes in the seals. Foam injection began on the evening of day fourteen and continued all night and all the day of day fifteen. Toward the end of day fifteen 142,000 cubic feet of foam had been injected into the cavity behind Seal No. 6. Based on gas sampling results on the evening of day fifteen, carbon monoxide and hydrogen levels were essentially normal indicating that the fire was extinguished. On day sixteen gas sampling concentrations had returned essentially to normal and normal operations in the mine were resumed. However, foam injection levels were maintained for several more days to make absolutely certain that the fire had been extinguished.

Using the method of the present invention, the operators were able to extinguish the fire in less than 48 hours. Normal mining operations were resumed in less than two days after the beginning of foam injection.

EXAMPLE 2

The following example illustrates another aspect of the invention in which the foam is expanded with nitrogen which has been chilled to a temperature below ambient. The combustible material involved in a coal fire normally has a surface temperature of about 1400° F. while involved in combustion. The fire suppressant/extinguishing material must both lower the temperature of the combustible material and smother it to prevent contact between it and oxygen or other fuels that may be present in the atmosphere surrounding the combustible material. The fire is considered to be extinguished when the surface temperature of the coal in the area involved has been educed to 90° F., a commonly accepted safe temperature determined by the Pennsylvania Department of Environmental Protection.

The rate of reduction of the surface temperature of burning coal is reduced radically when contacted by nitrogen expanded foam. However, it was determined that as the surface temperature of the coal approaches 150° F. the rate at which the temperature is lowered is substantially reduced thus extending the time required to bring the temperature of the surface of the combustible material down to 90° F., the accepted temperature at which it is considered safe for personnel to reenter the area that has been involved in the fire. In the case of a mine fire the unsafe area can often include the entire mine, which prevents placing the mine back in operation. It has been found that this time can be substantially reduced by the use of chilled nitrogen expanded foam.

To establish the effect of differences between the ambient temperature at the site of the fire and the temperature of the chilled foam, a thermal analysis was undertaken to determine the effect of the temperature of the nitrogen expanded foam on the time required to extinguish a fire in a coal mine. The ambient surface temperature at the site of the fire was calculated at 1400° F. and the ambient surface temperature of 90° F. at the fire site was selected as the point at which the fire was considered to be extinguished. In performing the thermal analysis it was assumed that under normal fire fighting conditions the foam passes through a line of between about 70 ft. to about 90 ft. in length and the temperature rise of the chilled foam is calculated to be about 10° F. between the chiller and the dispensing point. The equipment and system assumed to be used for fighting the fire was at described above in connection with FIGS. 1–4.

The thermal analysis was conducted for chilled nitrogen foam that would be dispensed at three different temperatures, i.e. ambient temperatures (about 72° F.), 60° F. and 55° F. to produce a temperature differential between 90° F. and the dispensed temperature of the foam of 18° F., 30° F. and 35° F. respectively. In accordance with the assumed normal operating conditions, the nitrogen at the chiller must be brought to a temperature of about 10° F. below the desired temperature at which it is to be dispensed, that is 62° F. to dispense a foam at ambient temperature, 50° F. to dispense foam at 60° F. and 45° F. to dispense foam at 55° F.

For purpose of the this example, which satisfies a worst case scenario, the foam was calculated to be dispersed at the rate of 90,000 $ft.^3$ per hour which is the maximum rate at which foam can be effectively produced with existing off the shelf nitrogen generators that are compatible with the equipment described in connection with FIG. 2. It will be understood, however, that the invention is not limited to the foregoing dispersion rate. The rate of production and dispersion of the chilled nitrogen foam will depend on the size of the area to be treated, the type of fire being controlled and the equipment available and the actual dispersion rate will be readily determined by those skilled in the fire fighting art. The coal burn period was assumed to be 48 hours for the purposes of the thermal analysis.

Employing the foregoing assumptions, x and y plots of temperature versus time were determined and plotted to produce temperature reduction curves for foam that was assumed to be injected at 72° F., 60° F. and 55° F. The plots are shown in FIG. 5 where the vertical axis is surface temperature in degrees F. and the horizontal axis is time in hours after foam injection.

Figure 5:
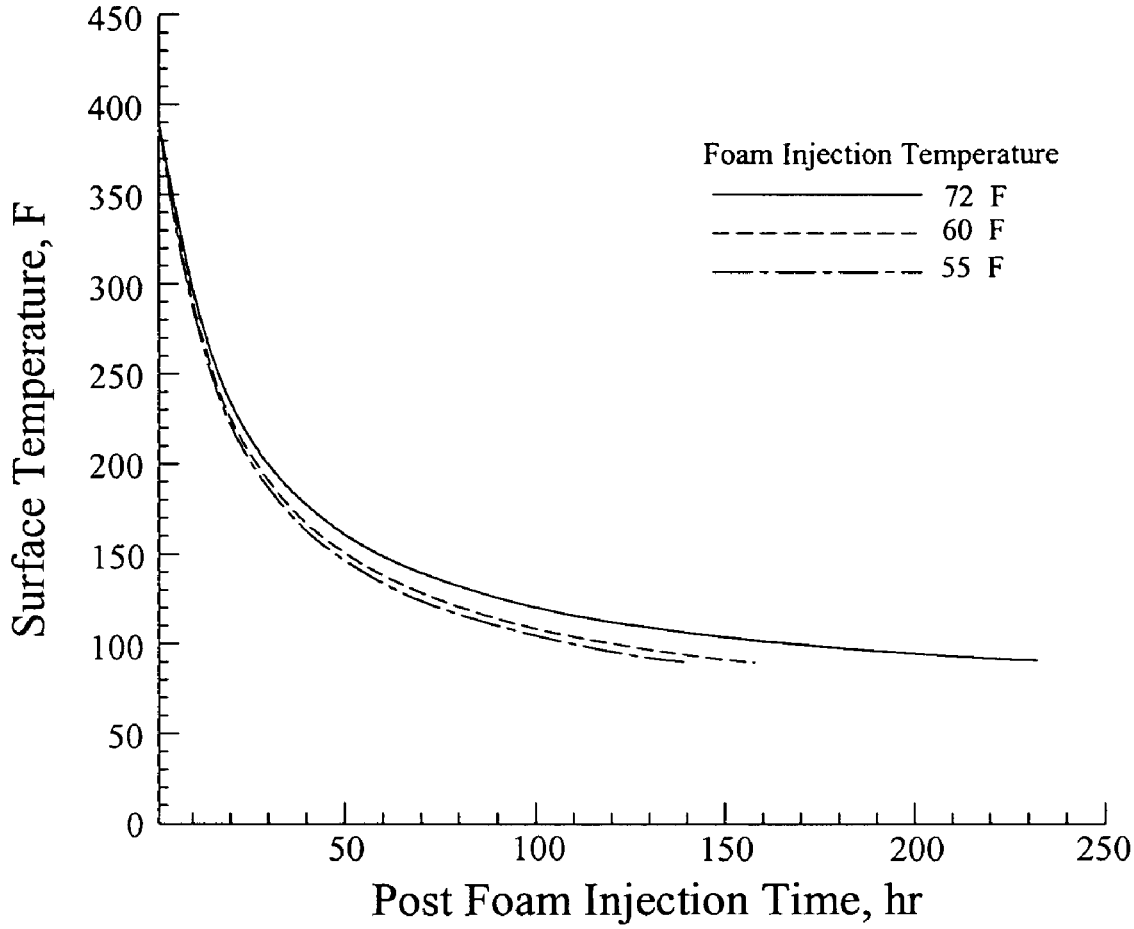
FIG. 5 is a plot of surface temperature versus post foam injection time illustrating the reduction of surface temperature for an area involved in combustion for foam injected at several temperatures.

As shown in FIG. 5 the rate of surface temperature reduction at the higher temperatures is relatively rapid and essentially the same for the foam that is injected at the three different temperatures. However, as the surface temperature approaches 250° F. the rate of reduction of the foam injected at 72° F. begins slow down and there is a substantial flattening in the curve at around 130° F. to about 120° F. Thereafter the rate of reduction is gradual and by extending the plot the temperature will reach 90° F. at about 300 hours (12.5 days). The curve for the nitrogen foam injected at 60° F. also begins to flatten out at about 130° F. and reaches 90° F. at about 160 hours (6.7 days). The curve for the nitrogen injected at a temperature of 55° F., although having a similar profile to the other curves, reaches 90° F. in about 137 hours (5.7 days). It can be seen, therefore, that as the difference between the dispensing temperature of the chilled nitrogen foam and 90° F. increases there is a substantial calculated decrease in the time required for the surface temperature of the coal to reach 90° F., the safe temperature at which personnel can reenter the mine. When the chilled nitrogen foam is dispensed at a temperature of 55° F. the calculated reduction in time is slightly greater than 50% as compared to nitrogen foam injected at ambient (72° F.) temperature. When injected at 60° F. the calculated reduction in time as compared to ambient nitrogen foam is around 46%. This represents a quicker return to operations and a substantial savings to the mine operators as well as an early return to work and full pay for the mine workers when the foam is dispensed at a reduced temperature.

From the foregoing thermal analysis it appears that the lower the temperature of the nitrogen the more effective is the nitrogen chilled foam in reducing the time to bring the surface temperature of the involved area to 90° F. Accordingly, depending upon the size and efficiency of the chiller, it is within the scope of the invention to chill the nitrogen to a temperature of about 45° F. or below.

It will be understood that the conditions encountered at the site of the fire can change the actual time required to extinguish the fire. Thus in Example 1 the conditions at the mine site resulted in extinguishing the fire in a period of about 48 hours using foam expanded with nitrogen at ambient temperature. However, from the foregoing thermal analysis it can be predicted that chilled nitrogen foam will result in extinguishing a fire in a coal mine in a substantially shorter period of time.

As indicated above, under ground mine fires as well as other types of fires in confined spaces are difficult to extinguish and can continue to burn for periods of weeks, months and indeed, even years. Once a first starts in an underground mine, for example, it is often the case that the mine has to be abandoned because the fire cannot be extinguished. An even more difficult situation occurs in the case of mines that have been closed and abandoned. A fire occurring in an abandoned mine is often allowed to burn for years in the hope it will burn itself out because the cost of extinguishing the fire is too great or because of the risk involved in attempting to extinguish the fire is too high. These fires can be a disaster both from an environmental aspect and a loss in property values incurred by those who live or own property in the area. The present invention allows such fires to be extinguished relatively quickly and inexpensively as compared to conventional methods of extinguishing mine fires.

While the invention has described above in connection with a coal mine fire, it will be understood that the method and apparatus of the invention is highly suited for extinguishing fire in other types of confined spaces. Thus, for example, landfill fires can be difficult to extinguish and can burn under the landfill with the generation of noxious pollutants. It is within the scope of this invention to insert a pipe or otherwise form an access path to the site of the fire. The nitrogen expanded foam can then be generated as described above either from the surface and pushed through the pipe or access path to the site of the fire or the diffuser can be inserted into the access path to bring it closer to the fire so that the travel of the foam is thus shortened.

As will be understood by those skilled in the art, various arrangements which lie within the spirit and scope of the invention other than those described in detail in the specification will occur to those persons skilled in the art. It is therefore to be understood that the invention is to be limited only by the claims appended hereto.

I claim:

1. A method for extinguishing a fire comprising the steps of:

a. proportioning foam concentrate into a non-inflammable liquid to form a foam concentrate/liquid mixture;

b. forming a flowing stream of said foam concentrate/liquid mixture;

c. chilling nitrogen gas to a temperature below about 70° F.;

d. mixing said nitrogen and said stream of said foam/liquid mixture to initiate the formation of a nitrogen expanded foam chilled fire suppressant; and e. dispensing said flowing stream carrying said chilled nitrogen expanded foam to effect the full expansion of said chilled nitrogen expanded foam and to introduce said chilled nitrogen expanded foam to an area involved in fire thereby to lower the temperature at the surface of combustible material at said area and to smother said fire.

2. The method of claim 1 wherein said nitrogen and said foam/concentrate are chilled essentially simultaneously to provide said chilled nitrogen expanded foam.

3. The method of claim 1 wherein said nitrogen is chilled prior to admixture with said foam concentrate/liquid mixture to form said chilled nitrogen expanded foam.

4. The method of claim 1 wherein said chilled nitrogen foam is dispensed at a temperature of less then about 60° F.

5. The method of claim 1 wherein said chilled nitrogen foam is dispensed at a temperature of about 55° F.

6. The method of claim 1 wherein said nitrogen is chilled to a temperature of less than about 50° F.

7. A method of claim 1 wherein said nitrogen is chilled to a temperature of less than about 45° F.

8. The method of fighting a coal mine fire comprising the steps of sealing a portion of a confined area of a coal mine involved in the fire to form a sealed portion of the confined area involved in the fire that is separated from areas of the confined area that are free of fire, dispensing a fire suppressant comprising a chilled nitrogen expanded foam to said sealed portion of said confined area thereby to initiate suppression of the fire and reduction of the surface temperature of combustible material in said sealed portion to about 90° F.

9. The method of claim 8 further including the step of forming said chilled nitrogen expanded foam by the introduction of nitrogen at a temperature at less than about 50° F. to a flowing stream of foam concentrate in a nonflammable liquid.

10. The method of claim 8 wherein said chilled nitrogen expanded foam is dispensed to said sealed portion of said confined area at a temperature of less than about 60° F.

11. The method of claim 8 wherein said nitrogen is chilled to a temperature of less than about 45° F.

12. The method of claim 8 wherein said chilled nitrogen expanded foam is dispensed to said sealed portion of said confined area at a temperature of about 55° F.

13. The method of claim 8 wherein said nonflammable liquid is water and said foam concentrate is a class A type foam concentrate.

14. Apparatus for extinguishing a fire utilizing a nitrogen expanded foam fire suppressant material comprising a source of a mixture of nonflammable liquid and foam concentrate, a source of chilled nitrogen, a diffuser including an eductor for introducing said chilled nitrogen into said mixture of nonflammable liquid and foam concentrate to act therein to initiate formation of a chilled nitrogen expanded foam and a dispenser for dispensing said chilled nitrogen expanded foam.

15. The apparatus of claim 14 further including apparatus for reducing the temperature of said nitrogen prior to its introduction into said mixture of nonflammable liquid and foam concentrate.

16. The apparatus of claim 14 wherein said source of chilled nitrogen comprises a nitrogen generator and a chilled in series with said nitrogen generator.

17. The apparatus of claim 14 wherein said mixture of nonflammable liquid and foam concentrate is held in a container and said chilled nitrogen is maintained in a separate container whereby said apparatus is portable.

* * * * *

UNITED STATES PATENT AND TRADEMARK OFFICE

CERTIFICATE OF CORRECTION

PATENT NO. : 7,104,336 B2
APPLICATION NO. : 10/942065
DATED : September 12, 2006
INVENTOR(S) : Ozment It is certified that error appears in the above-identified patent and that said Letters Patent is hereby corrected as shown below:

In the claims:

Claim 16, col. 12, line 58, change to read as follows: chilled nitrogen comprises a nitrogen generator and a chiller Signed and Sealed this Twentieth Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 7,104,336 B2
APPLICATION NO. : 10/942065
DATED : September 12, 2006
INVENTOR(S) : Alden Ozment It is certified that error appears in the above-identified patent and that said Letters Patent is hereby corrected as shown below:

Claim 1, col. 11, line 57, change “non-inflammable” to “non-flammable”

Signed and Sealed this

Ninth Day of December, 2008

JON W. DUDAS
*Director of the United States Patent and Trademark Office*